US005092325A

United States Patent [19]

Ainscough

[11] Patent Number: 5,092,325

[45] Date of Patent: Mar. 3, 1992

[54] SCUBA BREATHING APPARATUS

[76] Inventor: Kenneth S. Ainscough, Unit 4, Watery Lane Industrial Estate, Darwen, Lancashire, BB2 3EB, United Kingdom

[21] Appl. No.: 547,279

[22] Filed: May 14, 1990

Related U.S. Application Data

[63] Continuation of Ser. No. 143,825, Jan. 14, 1988, abandoned.

[30] Foreign Application Priority Data

Jan. 20, 1987 [GB] United Kingdom ..... 8701165

[51] Int. Cl.[5] ..... B63C 11/02

[52] U.S. Cl. ..... 128/201.27; 128/201.28; 128/202.14; 128/204.26; 128/205.24

[58] Field of Search ..... 128/201.27, 204.26, 128/205.24, 204.18, 201.28, 202.14

[56] References Cited

U.S. PATENT DOCUMENTS 3,147,499 9/1964 Nelson et al. ..... 128/202.14
4,068,657 1/1978 Kobzan ..... 128/202.14
4,219,017 8/1980 Shamlian et al. ..... 128/205.24

*Primary Examiner*—Edgar S. Burr
*Assistant Examiner*—Aaron J. Lewis
*Attorney, Agent, or Firm*—Reising, Ethington, Barnard, Perry & Milton

[57] ABSTRACT

A breathing apparatus for scuba diving comprising a reservoir for compressed air an inlet valve for the supply of air to a mouthpiece, an exhalation valve the apparatus being connectable to a buoyancy device characterized in that the apparatus comprises (i) a first valve body (1) incorporating a first mouthpiece (2) communicating with an air chamber (3) within the valve body, the chamber being provided with an exhalation valve (4) for exhaled air (ii) a demand valve (9) for controlling the supply of air from the reservoir to the air chamber (iii) a pressure responsive device, preferably a diaphragm (6) connected operably to the demand valve the connection being made preferably by a lever (12)

(iv) a second valve body (17) incorporating a valved mouthpiece (15) the second body being connectable to a buoyancy device preferably a garment and communicating through valve means (24) with air contained in the reservoir.

5 Claims, 1 Drawing Sheet

SCUBA BREATHING APPARATUS

This is a continuation of copening applications Ser. No. 07/143,825 filed on Jan. 14, 1988, now abandoned.

TECHNICAL FIELD

This invention relates to a breathing apparatus to be used by a scuba diver in the event of failure of his main breathing system.

BACKGROUND ART

In normal practice a diver carries with him air under pressure contained in a cylinder which communicates with a mouthpiece or mask worn by the diver via a reduction valve and regulator. In the event of failure of the system he must be able to take emergency measures in order to enable him to continue breathing at least for a sufficient time to enable him to rise to the surface of the water. Even if his system has not failed it should be flexible enough to enable him to share it with another diver who has encountered difficulty whilst continuing to use it himself. A further requirement is that the emergency measures should be sufficiently easy to take by a diver who may be in a stressed condition. One of the problems encountered in the design of diving equipment which is capable of performing a variety of functions stems from the fact that it tends to become very bulky and as a result it is liable to interfere with the movements of the diver. In some cases the design of the equipment may result in some limitation in the freedom of the diver to breathe and in other cases his vision might be obstructed by bubbles of exhaled air being discharged in front of his face. The present invention is directed to a breathing system which is both very versatile in its operation and more comfortable to use.

SUMMARY OF THE INVENTION

Accordingly this invention provides a breathing apparatus for scuba diving comprising (i) a first valve body incorporating a first mouthpiece communicating with an air chamber within the valve body the chamber being provided with an exhalation valve for exhaled air (ii) a demand valve for controlling the supply of air from a reservoir to the air chamber (iii) a pressure responsive device connected operably to the demand valve (iv) a second valve body incorporating a valved mouthpiece the second body being connectable to a buoyancy device and communicating through valve means with air contained in the reservoir

FIGURES IN THE DRAWINGS

This invention is illustrated but not restricted by the following drawings.

DETAILED DESCRIPTION OF THE INVENTION

Figure 1:
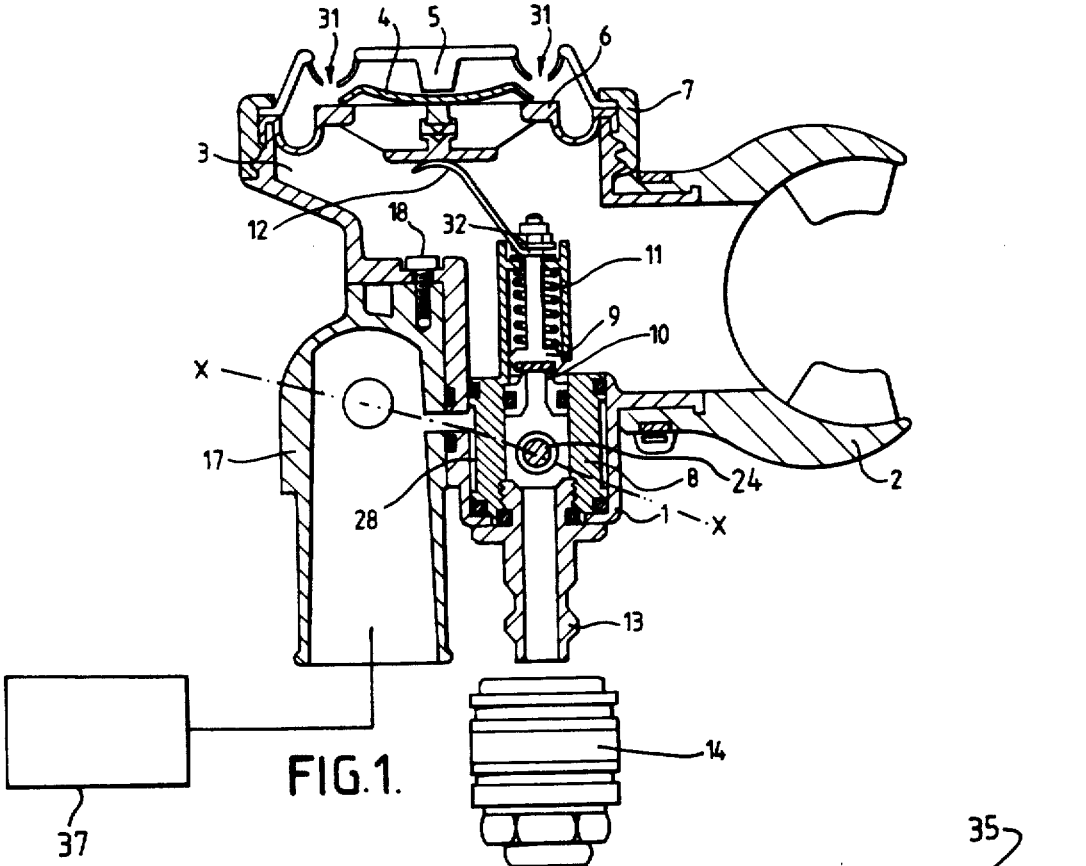
FIG. 1 is a side view taken in vertical section of one form of preferred apparatus made according to the invention.
Figure 2:
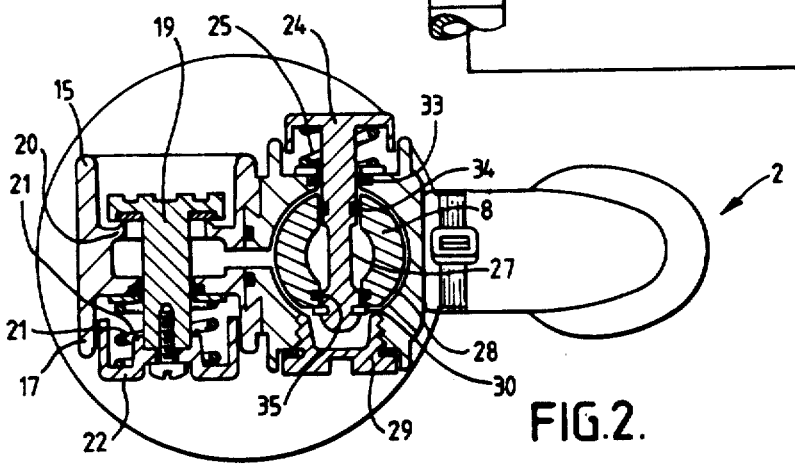
FIG. 2 is a view of the apparatus shown in FIG. 1 taken in section along line XX of the figure.

In these figures a first valve body (1) incorporates a first mouthpiece (2) which communicates with an air chamber (3). The chamber is provided with a pressure responsive device preferably a diaphragm (6) a combined end cover and purge button (5) and an exhalation valve (4). The combined end cover and purge button (5) incorporates an aperture or apertures (31) and a cover retaining ring (7). The combination is used to purge water from the air chamber (3). The diameter of the diaphragm is important because on it depends to a material extent the ease with which the diver can breath. Preferably the diameter should be within the range of 45–75 mm and preferably about 57 mm. The end cover is made preferably of rubber or other resilient material so that the purge button can be operated merely by pressing the end cover in the region of the button. A demand valve assembly is located within the air chamber and consists of a valve body (8), valve (9), valve seat (10) and a demand valve spring (11). The valve (9) is connected to diaphragm (6) by a lever (12) which rotates about a fulcrum (32) in the valve spring assembly. The assembly is fitted with an inlet nipple (13) to which is attached by means of connector (14) a length of hose conveying medium pressure gas, i.e. gas at about 120–140 lbs. per sq. inch via a first stage main regulator from a gas bottle or other form of reservoir of air (schematically shown at 35) under high pressure. The form of connector (14) is important and it should be of the kind which enables it to be fitted and removed very easily and quickly. A second valve body (17) is secured detachably to the first valve body by means of screw (18) and a valved mouthpiece (15) is incorporated with the wall of the second valve body and communicates through the second valve body with a buoyancy device (schematically shown at 37) which can be any form of inflatable garment for wear on the upper parts of the body of a diver for example a jacket or vest. The device is fitted preferably with a small cylinder of compressed air which is sufficient to inflate the device in case of an emergency. At the base of mouthpiece (15) there is a valve (19) held against a valve seat (20) by spring (21). The spring can be compressed by pushing button (22). Housing (17) connects directly to the buoyancy device (not shown).

The valve body (8) located within air chamber (3) also comprises a valve consisting of an operating button (24) acting against a spring (25). The operating button (24) is sealed in housing (1) by an 'O' ring seal (33) and a blanking plug (29). Operating button (24) is also sealed in the valve body (8) by two 'O' ring seals (34 and 35) and retained in position by a circlip (30) Housing (1) and valve body (8) define a concentric space (28) which is connected directly with second valve body (17) and the buoyancy device.

The versatility of the present apparatus can be demonstrated by showing how it can be used under different situations.

SITUATION 1

In the event of failure of the main demand regulator on the reservoir the diver inserts mouthpiece (2) and eliminates any water present in air chamber (3). In order to do this the diver has two courses open to him. He can either merely blow through the mouthpiece in which case air pressure rises in the chamber causing the exhalation valve (4) to open and to enable a mixture of air and water to escape into the cover (5) and out through the apertures (31). Alternatively he can press purge button (5) in which case lever (12) rotates about fulcrum (32). This causes valve (9) to lift off its seating (10) resulting in compressed air from the reservoir entering air chamber (3) to expel any water through the apertures (31) from the chamber.

When the chamber has been purged the diver then inhales. As a result the pressure drops in the air chamber causing the diaphragm to deform inwardly. This in turn brings about rotation of lever (12), opening of valve (9) and entry of air from the reservoir for consumption by the diver.

SITUATION 2

In this situation the diver requires to rise to the surface rapidly. In order to achieve this he presses button (24) which results in air being able to pass directly from the reservoir through the second valve chamber to the buoyancy device (not shown) which becomes inflated.

SITUATION 3

In the event of a total failure of supply of air from the reservoir the diver removes mouthpiece (2) and applies his mouth to a valved mouthpiece (15) and presses button (22). This has the effect of establishing direct communication between the mouthpiece (15) and the buoyancy device (not shown) through second valve body (17). The diver can then inhale air contained in the device which should be sufficient to enable him to reach the surface. In the event of the device being in a deflated condition at the time that button (22) is operated the device can be inflated rapidly by means of the emergency bottle of compressed air which is connected directly to the device.

SITUATION 4

On occasions the diver may wish to use the device under circumstances where the risk of accident is very low and where he wishes to have maximum of mobility. Under these circumstances he can by removing screw (18) which connects main valve body (1) and the second valve body (17) detach the latter together with the wide hose and buoyancy bag. It will be appreciated however that if desired the apparatus can be made in which the two housings are connected permanently.

The design of the apparatus can be modified in a number of different ways. For example the exhaled air can be diverted away from the outlets in the combined push button and cover (5) into a buoyancy device without the need for the diver removing first mouthpiece (2). In order to achieve this the apertures in the cover are replaced by a single aperture which can be blocked readily by the diver placing his thumb or other part of his hand over it. A one-way valve is incorporated preferably with the wall of first valve body (1). Various types of valves can be employed. However a rubber mushroom type valve which permits air to enter housing (17) but prevents it flowing in the reverse direction is preferred.

In use the diver exhales air and closes the aperture in cover (5). Consequently the pressure in air chamber (3) rises until the one-way valve opens and permits air to enter the second valve body (17) and to pass into the buoyancy device. The resistance to the passage of air by exhalation valve (4) is arranged to be substantially less than that presented by the one-way valve. Consequently when the aperture in cover (5) is not blocked the exhalation valve (4) can operate in the normal way.

A further variation resides in the location of the exhalation valve (4). Preferably the valve should be as near as possible to and combined with diaphragm (6) and combined cover and purge button assembly (5). However if desired the valve together with suitable discharge apertures can be located in any convenient position elsewhere in the wall of the first valve body (1).

I claim:

1. A breathing apparatus for scuba diving for being connected to a reservoir for compressed air and being connectable to a buoyancy device, characterized in that the apparatus comprises:

(i) a first valve body portion (1) incorporating a first mouthpiece (2) in fluid communication with an air chamber (3) adjacent with the first valve body portion (1), the chamber (3) being provided with an exhalation valve (4) for exhaled air;

(ii) a demand valve (9) for controlling the supply of air from the first valve body portion (1) to the air chamber (3);

(iii) a pressure responsive device (6) connected operably to the demand valve (9);

(iv) a second valve body portion (17) including a second mouthpiece (15) and first one way valve means (19) therein for controlling air flow from the second valve body portion (17) to said second mouthpiece (15) and second valve means (8) maintained in said valve body (1) for selectively opening and closing said first valve body portion (1) to said second valve body portion (17) and controlling the flow of air contained in the reservoir through said first valve body portion (1) to the second valve body portion (17) independent of said demand valve means (9) whereby air can selectively flow from a buoyancy device (37) to the second mouthpiece (15) and from the reservoir (35) to the second mouthpiece (15) and the first mouthpiece can be sealed from the buoyancy device (37).

2. An apparatus according to claim 1 wherein the pressure responsive device is a diaphragm.

3. An apparatus according to either of claim 2 wherein the diaphragm is connected operably to the demand valve by a lever.

4. An apparatus according to either of claim 2 wherein the diaphragm incorporates an apertured cover made of resilient material and provided with a purge button.

5. An apparatus according to claim 1 wherein the buoyancy device is a garment.

* * * * *